United States Patent [19]

Brammer

[11] Patent Number: 4,903,993

[45] Date of Patent: Feb. 27, 1990

[54] TIEBACK CONNECTOR WITH TWO POINT INTERFERENCE FIT

[75] Inventor: Norman Brammer, Fivie Turriff, Scotland

[73] Assignee: Vetco Gray Inc., Houston, Tex.

[21] Appl. No.: 291,187

[22] Filed: Dec. 28, 1988

[51] Int. Cl.[4] ..... F16L 55/00

[52] U.S. Cl. ..... 285/24; 285/115; 285/334.4; 285/370

[58] Field of Search ..... 285/24, 27, 115, 334.4, 285/370

[56] References Cited

U.S. PATENT DOCUMENTS

| | | | |
|---|---|---|---|
| 198,035 | 12/1877 | Matheson | 285/115 |
| 1,927,656 | 9/1933 | Eaton et al. | 285/115 |
| 2,406,478 | 8/1946 | Snyder | 285/115 |
| 2,574,081 | 11/1951 | Abegg | 285/115 |
| 2,580,818 | 1/1952 | Mundy et al. | 285/115 X |
| 4,343,495 | 8/1982 | Nobileau et al. . | |
| 4,408,784 | 10/1983 | Reimert . | |
| 4,429,904 | 2/1984 | Reimert | 285/24 |
| 4,609,046 | 9/1986 | Schawann et al. . | |
| 4,659,116 | 4/1987 | Cameron | 285/27 |
| 4,696,493 | 9/1987 | Brammer . | |

*Primary Examiner*—Thomas F. Callaghan
*Attorney, Agent, or Firm*—James E. Bradley

[57] ABSTRACT

A tieback connector for connecting a conductor to a subsea wellhead mandrel utilizes two points of interference fit. The tieback connector has a tubular body from which depends a downward opening funnel. The mandrel has an upper bearing surface and a lower bearing surface, spaced apart by a cylindrical wall section. The lower bearing surface protrudes outward and is a frustoconical surface. The mandrel has upper and lower bearing surfaces that are dimensioned to frictionally engage the upper and lower bearing surfaces of the mandrel as the funnel makes the final seat on the mandrel.

6 Claims, 1 Drawing Sheet

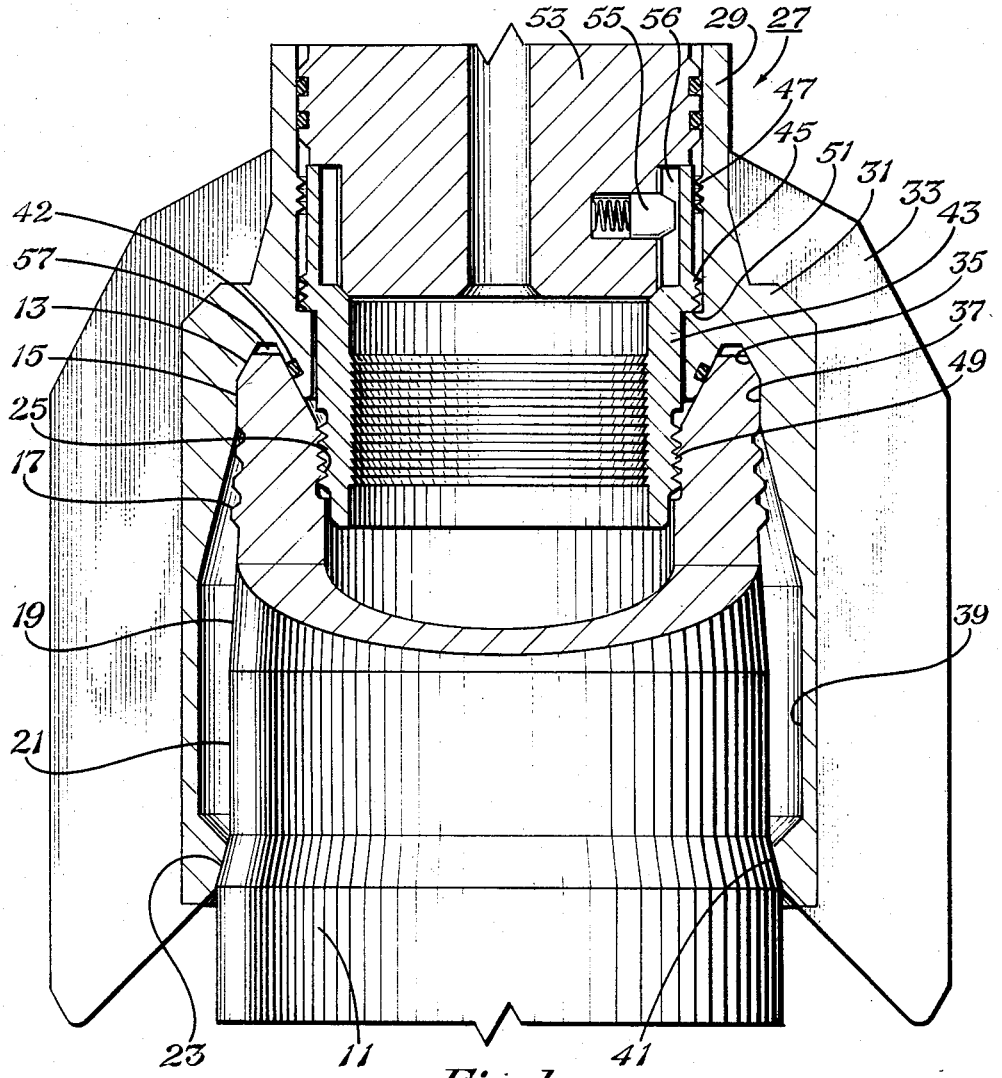
Fig. 1
Fig. 2
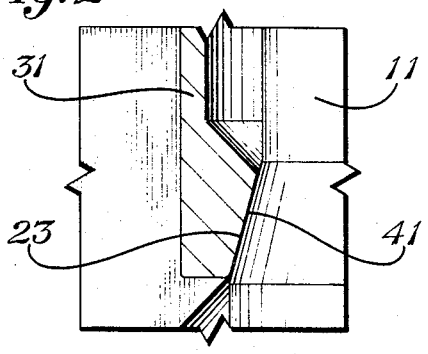
Fig. 3
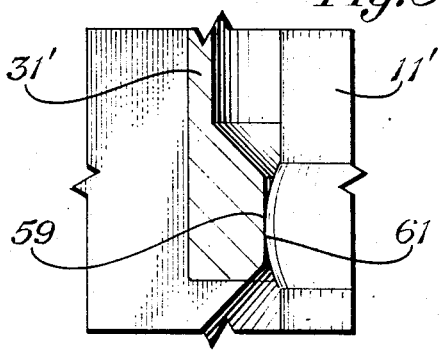

TIEBACK CONNECTOR WITH TWO POINT INTERFERENCE FIT

BACKGROUND OF THE INVENTION

1. Field of the Invention:

This invention relates in general to subsea wells and in particular to a connector for connecting a tieback conductor to a wellhead.

2. Description of the Prior Art:

The purpose of a tieback of a conductor string from a fixed platform to a previously drilled well is to achieve a structural connection between the well and platform that will resist internal pressure as well as externally applied axial, lateral and bending forces. A rigid connection between the conductor string and the wellhead is considered to be superior to a non-rigid type connection.

In U.S. Pat. No. 4,343,495, Philippe C. Nobileau et al, Aug. 10, 1982, and in U.S. Pat. No. 4,696,493, Norman Brammer, Sep. 29, 1987, the tieback systems utilize an internal bushing to provide a preloading contact between horizontal surfaces of the wellhead and the tieback connector. The connector utilizes a guide funnel for initial stabbing. Bearing surfaces in the funnel operate on the outside surface of the wellhead to force the conductor string into angular alignment with the wellhead under the influence of the weight of the conductor string. Seals located between the tieback connector and the wellhead are compressed with axial movement of the tieback connector. Then, the lock bushing is operated to clamp the connector to the wellhead.

SUMMARY OF THE INVENTION

In this invention, the tieback connector is also of the type utilizing a downward opening funnel. Structural rigidity between the conductor and the mandrel is achieved by interference fit of the diameters of the mandrel and the funnel at two points. Upper bearing surfaces on the mandrel and in the funnel frictionally engage each other as the funnel seats on the mandrel. A lower bearing surface is formed on the wellhead and protrudes outward therefrom. The funnel also has a lower bearing surface for mating with the lower bearing surface of the mandrel. The lower bearing surfaces engage each other frictionally, preferably with an interference fit, as the funnel lands on the mandrel.

In one embodiment, the lower bearing surface is a frusto-conical surface. In another embodiment, the lower bearing surface is a convex curved band formed on the wellhead.

BRIEF DESCRIPTION OF THE DRAWINGS

FIG. 1 is a vertical sectional view of a tieback connector constructed in accordance with this invention.

FIG. 2 is an enlarged view of a lower portion of the funnel of the tieback connector of FIG. 1.

FIG. 3 is a view similar to FIG. 2, but showing an alternate embodiment.

DESCRIPTION OF THE PREFERRED EMBODIMENT

Referring to FIG. 1, mandrel 11 is part of a subsea wellhead. Mandrel 11 is a tubular member that protrudes upward from a subsea floor. Mandrel 11 has an upper bearing surface. The upper bearing surface 13 is a frusto-conical surface that extends downward on the exterior of the mandrel 11 from the upper edge of the mandrel 11. A cylindrical surface 15 extends downward from the upper bearing surface 13. A plurality of grooves 17 are formed on the exterior of mandrel 11 below the cylindrical surface 15. A tapered section 19 leads downward from the grooves 17. Tapered section 19 leads into another cylindrical surface 21.

A lower bearing surface 23 is formed at the lower end of the cylindrical surface 21. Lower bearing surface 23 in the embodiment of FIGS. 1 and 2 is a frusto-conical surface. The vertical length of the lower bearing surface 23 is much less than the vertical distance from the upper bearing surface 13 to the lower bearing surface 23. The maximum diameter of the lower bearing surface 23, which is at its lower termination, is greater than the diameter of any portion of the mandrel 11 located above the lower bearing surface 23. Mandrel 11 has a set of interior threads 25 formed in its bore.

Tieback connector 27 has a tubular body 29. The body 29 is adapted to be connected to a conductor string (not shown). A funnel 31 extends downward from the body 29. Funnel 31 opens downward and has a plurality of ribs 33 on the exterior for strengthening.

Funnel 31 has within its interior an upper bearing surface 35 which is a frusto-conical surface adapted to mate with the upper bearing surface 13 on the mandrel 11. Upper bearing surface 35 is dimensioned for an interference fit. That is, its inner diameter at all points is slightly less than the outer diameter of the mandrel upper bearing surface 13 at the corresponding points. The angles of inclination of the bearing surfaces 13, 35 are the same.

A cylindrical surface 37 is formed in the funnel 31 directly below the upper bearing surface 35. Cylindrical surface 37 is adapted to fit very closely with the mandrel cylindrical surface 15. Preferably, the cylindrical surface 37 has a slight interference fit. The inner diameter of the cylindrical surface 37 is thus slightly less than the outer diameter of the cylindrical surface 15.

A large recess 39 extends downward from the cylindrical surface 37. The recess 39 has an upper tapered portion leading into a cylindrical portion. Recess 39 has an inner diameter that is greater than the diameters of the mandrel grooves 17, tapered section 19 and cylindrical surface 21 by a considerable amount. This results in a large clearance between the recess 39 and the cylindrical surface 21 of the mandrel 11.

A lower bearing surface 41 is formed on the lower end of the funnel 31. Lower bearing surface 41 in the embodiments of FIGS. 1 and 2 is a frusto-conical surface that extends inward from the interior of the funnel 31. Lower bearing surface 41 is positioned to mate with the mandrel lower bearing surface 23. Lower bearing surface 41 is dimensioned for an interference fit with the mandrel lower bearing surface 23. The taper of the lower bearing surface 41 is the same as the angle of taper of the lower bearing surface 23. Its inner diameter measured at any point is slightly less than the outer diameter of the mandrel lower bearing surface 23 at the corresponding points so as to provide an interference fit. A seal 42 is located in an upper inner conical portion of the funnel 31 for mating and sealing against a conical portion on the interior of mandrel 11 at its rim.

The tieback connector 27 may be locked to the mandrel 11 by various means. In the embodiments shown, the locking means comprises a lock nut 43. Lock nut 43 has a set of upper threads 45. The upper threads 45 are positioned to engage threads 47 formed in the body 29 prior to connecting the lock nut 43 to the mandrel 11. The lock nut 43 is carried in an upper position with the threads 45 engaging the threads 47 until the funnel 31 is seated on the mandrel 11.

Lock nut 43 also has a set of lower threads 49. The lower threads 49 engage the mandrel threads 25 to connect the lock nut 43 to the mandrel 11. A downward facing shoulder 51 on the lock nut 43 bears against a shoulder formed in the connector body 29 to provide an axial compressive preload when connecting the lock nut 43 to the mandrel 11.

The lock nut 43 is secured in place by a running tool 53 that is lowered down and through the conductor string (not shown). The running tool 53 has a dog 55 that engages a slot 56 so that rotation of the running tool 53 will rotate the lock nut 43.

In operation, the tieback connector 27 will be lowered down onto the mandrel 11. The funnel 31 will slide over the mandrel 11. The funnel lower bearing surface 41 will frictionally engage the mandrel lower bearing surface 23. At the same time, the funnel upper bearing surface 35 will frictionally engage the mandrel upper bearing surface 13. The upper bearing surfaces 13, 35 and lower bearing surfaces 23, 41 will normally not be fully engaged at this point, but will lack about one inch or so of vertical travel.

Then, the running tool 53 rotates the lock nut 43 to unscrew the threads 45 from threads 47. The lock nut 43 drops down into the mandrel 11. Further rotation causes the lock nut threads 49 to tighten against the mandrel threads 25. The torque plus the weight of the conductor string forces the funnel 31 down farther about one inch until the seal 42 seals against the inner conical rim of the mandrel 11. During this final downward movement, the funnel bearing surfaces 35, 41 will frictionally slide on the mandrel bearing surfaces 13, 23 in an interference fit.

The tightening of the lock nut 43 locks the tieback connector 27 to the mandrel 11. When locked to the mandrel 11, a clearance 57 will exist between the upper rim of the mandrel 11 and an annular groove in the funnel 31. Radial preload will exist between the cylindrical surfaces 15 and 37. This preload force is perpendicular to the axis of the mandrel 11. Also, radial preload components will exist between the two upper bearing surfaces 13 and 35 and the two lower bearing surfaces 23 and 41. These inward directed forces intersect the axis of the mandrel 11 at the same angle as the angle of the tapers of the frustoconical surfaces of the upper bearing surfaces 13, 35 and lower bearing surfaces 23, 41.

In the embodiment of FIG. 3, the mandrel lower bearing surface 59 is a curved band with a convex shape. Both the upper and lower terminations of the lower bearing surface 59 are gradually curved in a generally convex shape. Lower bearing surface 59 has a diameter at its maximum point that is greater than the diameter of any portions of the mandrel 11' above the lower bearing surface 59. In this embodiment, the lower bearing surface of the funnel 31' is a cylindrical band 61 formed on the lower edge. Cylindrical band 61 has an inner diameter that is slightly less than the maximum diameter of the band 59. This creates an interference fit as the funnel 31 is lowered over the mandrel 11.

The invention has significant advantages. The frictional, interference fits at two spaced apart vertical points on the mandrel and funnel provide a structural rigid connection. The interference does not occur until substantially at the final seating point of the funnel over the wellhead. The actual vertical distance of each interfering section is small relative to the overall length of the funnel. Consequently, the actual amount of work required to achieve the interference fit is reasonable. The weight of the tieback string, and the force of the rotation of the lock nut accomplish the interfering fit.

While the invention has been shown in only two of its forms, it should be apparent to those skilled in the art that it is not so limited, but is susceptible to various changes without departing from the scope of the invention.

I claim:

1. In a tieback connector for connecting a conductor to a subsea wellhead having an upward extending mandrel, the tieback connector having a tubular body from which depends a downward opening funnel, the improvement comprising:

mandrel upper and lower bearing surfaces formed on the mandrel, vertically spaced apart from each other, the mandrel lower bearing surface protruding outward from the mandrel;

a locking means carried by the funnel for securing the funnel to the mandrel without rotation of the funnel; and funnel upper and lower bearing surfaces formed in the funnel and dimensioned to frictionally engage the mandrel upper and lower bearing surfaces, respectively, when the locking means secures the funnel to the mandrel.

2. In a tieback connector for connecting a conductor to a subsea well head having an upward extending mandrel, the tieback connector having a tubular body from which depends a downward opening funnel, the improvement comprising:

mandrel upper and lower bearing surfaces formed on the mandrel, vertically spaced apart from each other, the mandrel lower bearing surface protruding outward from the mandrel;

locking means carried by the funnel for securing the funnel to the mandrel without rotation of the funnel; and funnel upper and lower bearing surfaces formed in the funnel and dimensioned to frictionally engage the mandrel upper and lower bearing surfaces, respectively, when the locking means secures the funnel to the mandrel, the mandrel lower bearing surface and funnel lower bearing surface being dimensioned to engage each other in an interference fit, the points at which the mandrel lower bearing surface engages the funnel lower bearing surface being slightly greater in diameter than the corresponding points on the funnel lower bearing surface.

3. In a tieback connector for connecting a conductor to a subsea well head having an upward extending mandrel, the tieback connector having a tubular body from which depends a downward opening funnel, the improvement comprising:

mandrel upper and lower bearing surfaces formed on the mandrel, vertically spaced apart from each other, the mandrel lower bearing surface being an annular tapered surface protruding outward from a cylindrical portion of the mandrel and having a diameter at its lower termination that is greater than any portion of the mandrel above the mandrel lower bearing surface;

locking means carried by the funnel for securing the funnel to the mandrel without rotation of the funnel; and funnel upper and lower bearing surfaces formed in the funnel and dimensioned to frictionally engage the mandrel upper and lower bearing surfaces, respectively, when the locking means secures the funnel to the mandrel, the funnel lower bearing surface being a tapered annular surface protruding inward from the lower end of the funnel and dimensioned with a slightly less diameter than the mandrel lower bearing surface to engage the mandrel lower bearing surface in an interference fit.

4. In a tieback connector for connecting a conductor to a subsea wellhead having an upward extending mandrel, the tieback connector having a tubular body from which depends a downward opening funnel, the improvement comprising:

mandrel upper and lower bearing surfaces formed on the mandrel, vertically spaced apart from each other, the mandrel lower bearing surface being an annular frustoconical surface protruding outward from a cylindrical portion of the mandrel and having a diameter at its lower termination that is greater than any portion of the mandrel above the mandrel lower bearing surface;

locking means carried by the funnel for securing the funnel to the mandrel without rotation of the funnel; and funnel upper and lower bearing surfaces formed in the funnel and dimensioned with the funnel upper and lower bearing surfaces having diameters at the points where they engage the mandrel upper and lower bearing surfaces that are slightly less than the corresponding diameters of the mandrel upper and lower bearing surfaces, to frictionally engage the mandrel upper and lower bearing surfaces in an interference fit, respectively, when the locking means secures the funnel to the mandrel, the funnel lower bearing surface being a frusto-conical angular surface protruding inward from the lower end of the funnel, defining a recess area between the funnel upper and lower bearing surfaces that is spaced from the mandrel when the funnel is secured to the mandrel.

5. In a tieback connector for connecting a conductor to a subsea well head having an upward extending mandrel, the tieback connector having a tubular body from which depends a downward opening funnel, the improvement comprising:

mandrel upper and lower bearing surfaces formed on the mandrel, vertically spaced apart from each other, the mandrel upper and lower bearing surfaces being annular frusto-conical surfaces, the mandrel lower bearing surface protruding outward from a cylindrical portion of the mandrel and having a diameter at its lower termination that is greater than any portion of the mandrel above the mandrel lower bearing surface;

locking means carried by the funnel for securing the funnel to the mandrel without rotation of the funnel; and funnel upper and lower bearing surfaces formed in the funnel and dimensioned to frictionally engage the mandrel upper and lower bearing surfaces in an interference fit, respectively, when the locking means secures the funnel to the mandrel, with the funnel upper and lower bearing surfaces having diameters at the points where they engage the mandrel upper and lower bearing surfaces that are slightly less than the corresponding diameters of the mandrel upper and lower bearing surfaces, respectively, the funnel upper and lower bearing surfaces being frustoconical annular surfaces, the funnel lower bearing surface protruding inward from the lower end of the funnel, defining a recess area between the funnel upper and lower bearing surfaces that is spaced from the mandrel when the funnel is secured to the mandrel.

6. In a tieback connector for connecting a conductor to a subsea wellhead having an upward extending mandrel, the tieback connector having a tubular body from which depends a downward opening funnel, the improvement comprising:

mandrel upper and lower bearing surfaces formed on the mandrel, vertically spaced apart from each other, the mandrel lower bearing surface protruding outward from the mandrel and having a curved upper portion that is generally convex;

locking means carried by the funnel for securing the funnel to the mandrel without rotation of the funnel; and funnel upper and lower bearing surfaces formed in the funnel and dimensioned to frictionally engage the mandrel upper and lower bearing surfaces, respectively, when the locking means secures the funnel to the mandrel, the funnel lower bearing surface being a substantially cylindrical surface having an inner diameter that is slightly less than the outer diameter of the mandrel lower bearing surface at its maximum dimension, to engage the mandrel lower bearing surface in an interference fit.

* * * * *